US005507213A

United States Patent [19]

Beseke

[11] Patent Number: 5,507,213

[45] Date of Patent: Apr. 16, 1996

[54] SHOULDER REST DEVICE FOR USE WITH A VIOLIN OR VIOLA

[76] Inventor: Tamsen Beseke, 202 N. Primrose Ave., Monrovia, Calif. 91016

[21] Appl. No.: 320,316

[22] Filed: Oct. 11, 1994

[51] Int. Cl.[6] ..... G10D 1/02

[52] U.S. Cl. ..... 84/280

[58] Field of Search ..... 84/278, 279, 280

[56] References Cited

U.S. PATENT DOCUMENTS 4,884,487 12/1989 Feldkamp ..... 84/280
4,951,541 8/1990 McMillan ..... 84/280

*Primary Examiner*—Cassandra C. Spyrou
*Attorney, Agent, or Firm*—Frederick Gotha

[57] ABSTRACT

A shoulder rest for a violin or viola musical instrument having a support member made of an elastic polyurethane foam material and having opposing surfaces where said surfaces have a multiplicity of regions of depressions and regions of elevations and are so dimensioned and proportioned to permit the regions of elevation to exclusively and compressively bear against the back of the violin such that external forces transmitted to the support member are resiliently transferred through the regions of elevation thereby reducing the bearing surface area against the back of the musical instrument and consequently minimizing the dampening effect the support member has on the sound of the violin or viola. The shoulder rest is removably mounted to the musical instrument by a continuous elastic band carried by the support member and having opposing bights for compressively engaging the lower bout and end peg of the instrument.

18 Claims, 3 Drawing Sheets

SHOULDER REST DEVICE FOR USE WITH A VIOLIN OR VIOLA

FIELD OF THE INVENTION

This invention relates to an elastic shoulder rest device for cushioning the back of a violin against the musician's shoulder while the violin is being played.

BACKGROUND OF THE INVENTION

Violin shoulder rests have been used in the prior art to promote neck and back comfort for the musician, particularly when the violin is played for extended periods of time. While the instrument is being played, it is held in position by the musician by pressing against the chin rest located on the front face of the violin which in turn forces the back face to bear against the musician's shoulder area. Although it is desirable for violin shoulder rests to be of extremely light weight, most shoulder rests of the prior art are relatively heavy, usually made of metal, and clamped to the violin. Metal clamps are potentially damaging to the fine finished wood of the violin because the metal clamping action exposes the finished surface of wood to surface striations. Air bags have also been used in the prior art as shoulder rests and the bags are clamped to the violin in a manner similar to the metal rests; the air bag unfortunately has a tendency to slide on the rear surface of the violin consequently causing the musician to frequently alter his neck and back position in order to securely hold the violin. Air bags also have a tendency because of their flush bearing against the backside of the violin to dampen its sound. The shoulder rest device of this invention is made of an elastic material, preferably a polyurethane foam material which contains a plurality of elevated engagement regions or surfaces which are integrally formed and bear against the backside of the violin. The elevated engagement surfaces prevent a flush engagement between the backside of the violin and the shoulder rest thereby minimizing the bearing surface and the dampening of the sound of the violin. The engagement surfaces also securely grip the instrument thereby allowing the musician to move his shoulders and hands more freely while keeping the instrument steady.

SUMMARY OF THE INVENTION

There is, therefore, provided according to the present invention, a shoulder rest for a violin which permits the musician to more firmly grip the instrument without dampening the sound of the violin and to comfortably play the violin for extended periods of time.

The present invention is directed to a shoulder rest for a violin or viola. The shoulder rest consists of a support member which is made of a Polyurethane foam material. A plurality of elastic engagement surfaces or elevated regions are integrally formed in and extend from the support member. The engagement surfaces are defined by a multiplicity of regions of depressions and regions of elevations where the regions of elevation are so dimensioned and proportioned to permit the regions of elevation to exclusively and compressively bear against the violin such that external forces transmitted through the support member are exclusively transmitted through the regions of elevation thereby reducing the bearing surface of the support member against the violin. Thus, the violin is cushioned against the shoulder by an irregular surface engagement with the back of the violin which substantially eliminates any dampening of the violin sound by the support. To mount the rest to the violin, an elastic band is utilized which extends laterally from the support member and forms opposing bights for engagement with the bout of the violin and the end peg respectively. The bights are looped about the bout and the end peg and thus permit removable mounting of the support member to the violin.

BRIEF DESCRIPTION OF THE DRAWINGS

These and other features and advantages will become appreciated as the same become better understood with reference to the following specification, claims and drawings wherein:

DETAILED DESCRIPTION

Figure 1:
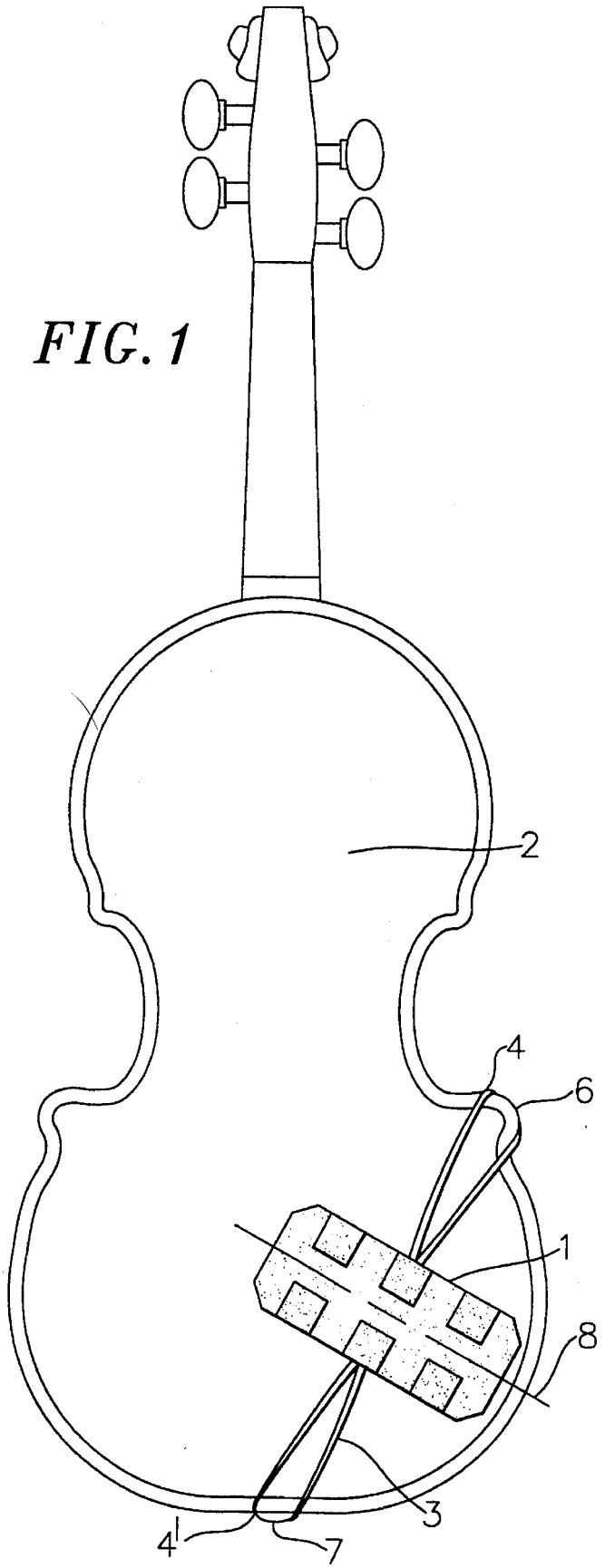
FIG. 1 is a view of the backside of a violin illustrating the shoulder rest mounted to the violin.

FIG. 1 illustrates the shoulder rest 1 of this invention mounted to the backside 2 of a typical violin or viola. As can be seen in FIG. 1, the shoulder rest has an elastic band 3 which is a continuous member that extends through the shoulder rest and forms laterally opposing loops or bights 4 and 4'. The bights are more clearly shown in FIG. 2 in an unextended or equilibrium position. Referring again to FIG. 1, the shoulder rest 1 is mounted to the backside 2 of the violin by elastic band 3 being stretched such that the loop or bight 4 loops the lower bout 6 of the violin and the opposing loop or bight 4' loops the end peg or button 7 of the violin. Thus, to mount the shoulder rest 1 to the backside of the violin, the elastic band is stretched laterally of the longitudinal axis 8 until the opposing bights 4 and 4' loop respectively the lower bout 6 and end peg 7 of the violin. As a result of the elasticity of the elastic band, restoring forces acting to return the band to its equilibrium position retain the band in compressive contact with the lower bout 6 and end peg 7 which permits removable mounting of the shoulder rest 1 to the violin.

Figure 2:
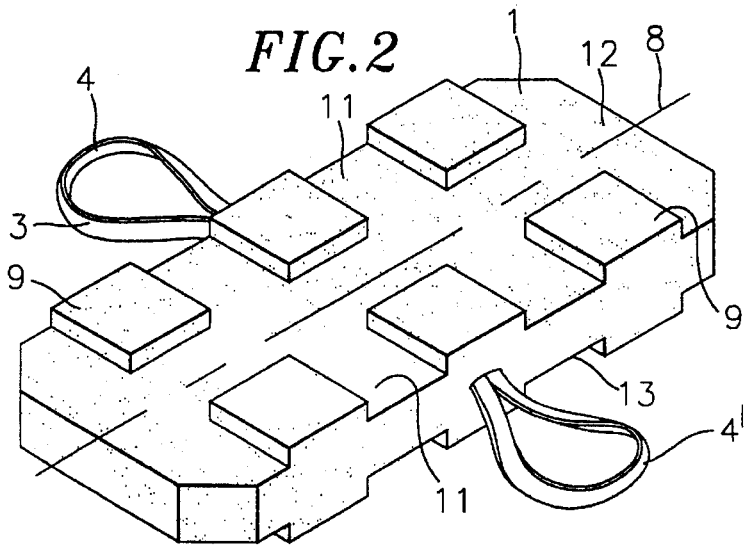
FIG. 2 is a perspective view of the shoulder rest of this invention.
Figure 4:
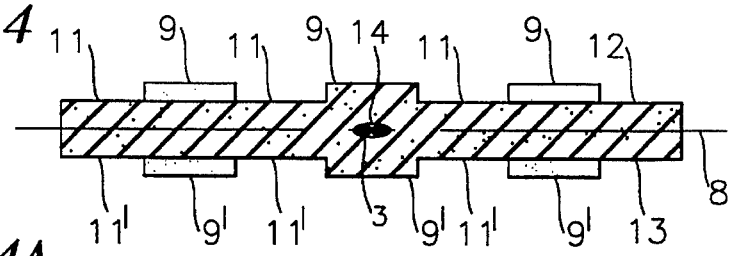
FIG. 4 is a cross-sectional view taken along the line 4—4.

One embodiment of this invention is illustrated in FIG. 2. As can be seen in FIG. 2, shoulder rest 1 has an irregular surface which is comprised of a multiplicity of regions of elevation 9 and regions of depression 11. The upper surface 12 of the shoulder rest is a mirror image of the bottom surface 13 and as can be seen in FIG. 4, bottom surface 13 has a multiplicity of regions of elevations 9' and regions of depression 11'. In this embodiment the preferred axial dimension of the shoulder rest is 3½ inches; the lateral width 1½ inches, and the thickness or vertical distance between the regions of depression on surfaces 12 and 13 to be approximately ½ of an inch; the regions of elevation are preferred to have a vertical dimension of ⅛ of an inch and to be of a square shape having an axial dimension of ½ inch and a lateral dimension of ½ inch. In this embodiment, the regions of elevations are symmetrically located with respect to longitudinal axis 8 on the surfaces 12 and 13 of the shoulder rest as is illustrated in the perspective view of the shoulder rest shown in FIG. 2.

Figure 3:
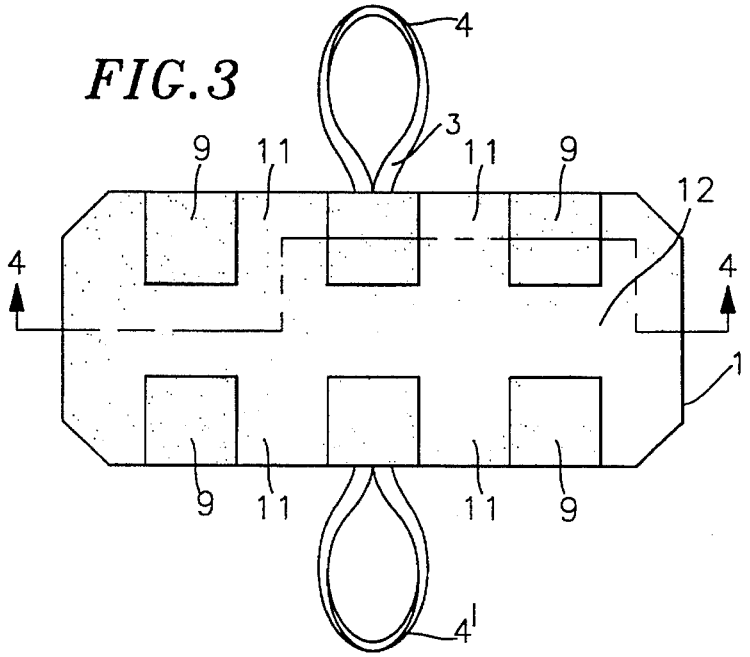
FIG. 3 is a bottom view of FIG. 2.

FIG. 3 is a top view of FIG. 2 and illustrates the symmetrical location of the regions of elevation on surface 12. Also, FIG. 3 contains the line 4—4 through which a cross-sectional view of shoulder rest 1 is taken; this cross-section is illustrated in FIG. 4. As can be seen in FIG. 4, shoulder rest 1 is made of a resilient compressible elastic material and elastic member 3 passes through a laterally extending cavity 14 which is sufficiently dimensioned to captively retain elastic band 3 within the cavity.

The preferred material for the embodiment illustrated in FIG. 2 is a Polyurethane foam and as can be seen in FIG. 4, the regions of elevation 9 and 9' are integrally contained in shoulder rest 1. Although in the embodiment shown in FIG. 2 the regions of elevation 9 and 9' are integrally formed in the shoulder rest, in other embodiments, the regions of elevation may be separate members bonded to the surface 12 of the shoulder rest.

Figure 4A:
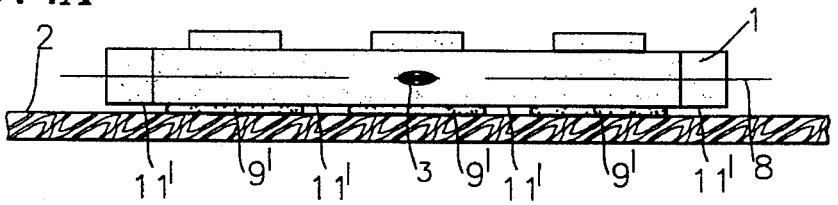
FIG. 4A is a side view of FIG. 3 illustrating the regions of elevation and compressive engagement with the backside of the violin.

FIG. 4A illustrates the cushioning provided by shoulder rest 1 against the backside 2 of the violin. As can be seen in FIG. 4A, the regions of elevation 9' are in compressive engagement with backside 2. The regions of depression 11' however, are not in bearing relationship with the backside of the violin which permits the violin to be cushioned through a reduced engagement surface and thus minimizes the dampening effect of the shoulder rest on the sound of the violin.

Figure 5:
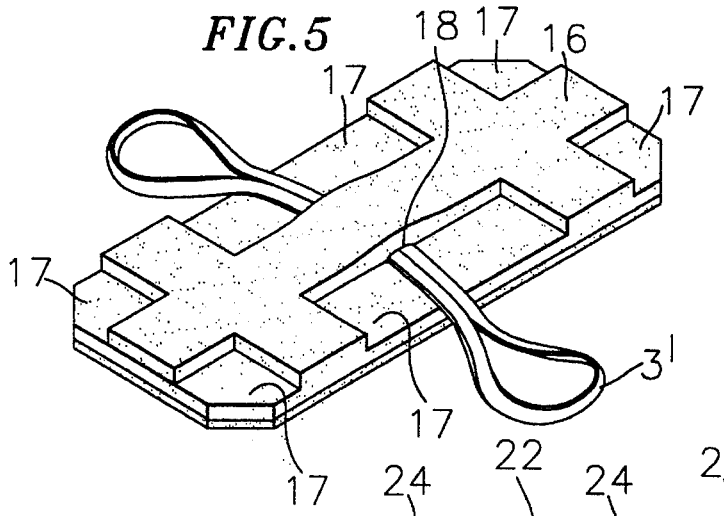
FIG. 5 is a perspective view of another embodiment of this invention.

Another embodiment of this invention is shown in FIG. 5. In FIG. 5, the engagement surface 16 of the region of elevation is a continuous surface and essentially planar. As in the above-described embodiment, the regions of depression 17 are of sufficient depth to permit the surface region of elevation 16 to compress against the backside 2 of the violin such that the engagement area of the shoulder rest is minimized and consequently results in less dampening of the violin sound. In this embodiment, the preferred material is a Polyurethane foam and as can be seen in FIG. 5, the shoulder rest is of a continuous construction and contains a channel 18 which extends laterally through the elevated region and through which elastic band 3' extends. As in the previously described embodiment, to removably mount the shoulder rest to the backside of the violin, elastic band 3' has opposing bights for looping about the lower bout 6 and end button 7 of the violin.

Figure 6:
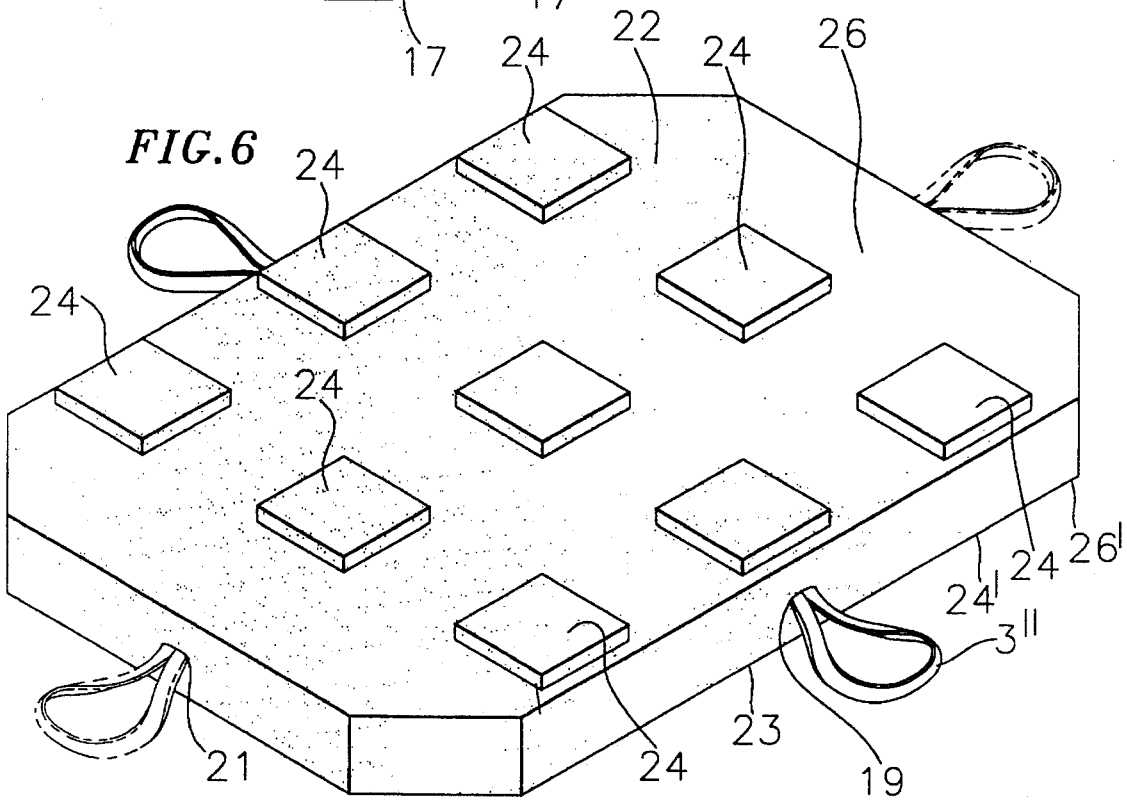
FIG. 6 is a perspective view of yet another embodiment of this invention.

Yet another embodiment of this invention is illustrated in FIG. 6. In this embodiment, the material of which the shoulder rest is made is preferably a Polyurethane foam material; however, any other material having the physical properties of a Polyurethane foam material would be suitable. As in the previously described embodiments, elastic band 3" permits the shoulder rest to be removably mounted to the backside of the violin through the use of loops or bights which are looped around the lower bout 6 of the violin and the end button 7. To attach elastic band 3" to the shoulder rest, it is inserted through a laterally extending cavity 19 or, alternatively, elastic band 3" may be inserted through a longitudinally extending cavity 21 as illustrated in phantom in FIG. 6. The embodiment of this invention shown in FIG. 6 has a top surface 22 which is the mirror image of bottom surface 23. Top surface 22 has a multiplicity of regions of elevation 24 and similarly bottom surface 23 has a multiplicity of regions of elevation 24'. The regions of elevation 24 and 24' are preferably square shaped with sides measuring ⅝ of an inch; the vertical height of regions of elevation 24 and 24' is preferably ⅛ of an inch. Although not shown in the figures, bottom surface 23 is identical to top surface 22 and as above-mentioned, a mirror image of top surface 22. The shoulder rest of this embodiment has an upper region of depression 26 which is planar and a lower region 26' which is also planar; the vertical distance between regions of depression 26 and 26' is preferably ½ inches. This distance between the regions of depression is variable and depends upon the physical characteristics of the violin player. As in the embodiment described in FIG. 2, the regions of elevation 24' (not shown on the figures) compress against the backside 2 of the violin (as shown in FIG. 4A) and thus present an engagement surface of reduced area which minimizes the dampening effect of the shoulder rest on the sound of the violin.

While I have shown and described embodiments of a shoulder rest for a violin or a viola, it is to be understood that the invention is subject to many modifications without departing from the scope and spirit of the claims as recited herein.

What is claimed is:

1. A shoulder rest having an upper boundary surface, a bottom boundary surface, and a peripheral boundary surface for use with a violin or viola musical instrument comprising:

a) an elastic member made entirely of a non-rigid resilient compressible elastic material and having a longitudinal axis, an upper surface coincident with and identical to said upper boundary surface, a bottom surface coincident with and identical to said bottom boundary surface, and a peripheral surface coincident with and identical to said peripheral boundary surface and integrally interconnecting said upper and bottom surfaces of said elastic member, said upper surface having in said upper surface a multiplicity of regions of depressions and regions of elevations where said regions of elevations are so dimensioned and proportioned to permit said regions of elevations to exclusively and compressively bear against said musical instrument while said bottom surface of said elastic member is at least in part in compressive engagement with a shoulder such that external forces acting on said upper surface of said elastic member are exclusively and resiliently transmitted through said regions of elevations;

b) elastic mounting means carried by said elastic member for removably mounting said elastic member to said musical instrument.

2. The shoulder rest for a violin recited in claim 1 wherein said elastic mounting means comprises an elastic band having laterally opposing bights for attachment to a lower bout of said musical instrument and an end peg of said musical instrument respectively.

3. The shoulder rest for a violin recited in claim 2 wherein said elastic member has a laterally extending cavity therethrough and said elastic band is captively held within said cavity.

4. The shoulder rest for the musical instrument recited in claim 1 wherein said multiplicity of regions of elevations are planar surfaces contained in said upper surface of said elastic member and said regions of depressions are planar surfaces contained in said upper surface of said elastic member and where said planar surfaces of said regions of elevations and depressions are substantially parallel.

5. The shoulder rest for the musical instrument recited in claim 4 where said regions of elevations are symmetrically located with respect to said longitudinal axis.

6. In combination:

(a) a violin or viola musical instrument;

b) a shoulder rest having an upper boundary surface, a bottom boundary surface, and a peripheral boundary surface made entirely of a non-rigid resilient compressible elastic material and having a longitudinal axis, where said shoulder rest comprises an elastic member having an upper surface coincident with and identical to said upper boundary surface, a bottom surface coincident with and identical to said bottom boundary surface, and a peripheral surface coincident with and identical to said peripheral boundary surface and integrally interconnecting said upper and bottom surfaces of said elastic member, said upper surface having in said upper surface a multiplicity of regions of depressions and regions of elevations where said regions of elevations are so dimensioned and proportioned to permit said regions of elevations to exclusively and compressively bear against said musical instrument while said bottom surface is at least in part in compressive engagement with a shoulder such that external forces acting on said upper surface of said shoulder rest are exclusively and resiliently transmitted through said regions of elevations;

(c) elastic mounting means carried by said elastic member for removably mounting said elastic member to said musical instrument.

7. The shoulder rest for the musical instrument recited in claim 6 wherein said elastic mounting means comprises an elastic band having laterally opposing bights for attachment to a lower bout of said musical instrument and an end peg of said musical instrument respectively.

8. The shoulder rest for the musical instrument recited in claim 7 wherein said support member has a laterally extending cavity therethrough and said elastic band is captively held within said cavity.

9. The shoulder rest for the musical instrument recited in claim 6, wherein said multiplicity of regions of elevations are planar surfaces contained in said upper surface of said elastic member and said regions of depressions are planar surfaces contained in the upper surface of the elastic member where said planar surfaces of said regions of elevations and depressions are substantially parallel.

10. The shoulder rest for the musical instrument recited in claim 9 where said regions of elevations are symmetrically located with respect to said longitudinal axis.

11. A shoulder rest having an upper boundary surface, a bottom boundary surface, and a peripheral boundary surface for use with a violin or viola musical instrument comprising:

(a) an elastic member made entirely of a non-rigid resilient compressible elastic material and having a longitudinal axis, an upper surface coincident with and identical to said upper boundary surface, a bottom surface coincident with and identical to said bottom boundary surface, and a peripheral surface coincident with and identical to said peripheral boundary surface and integrally interconnecting said upper and bottom surfaces of said elastic member, said upper surface having integral therewith a multiplicity of regions of depressions and regions of elevations where said regions of elevations are so dimensioned and proportioned to permit said regions of elevations to exclusively and compressively bear against said musical instrument while said bottom surface is at least in part in compressive engagement with a shoulder such that external forces acting on said upper surface of said elastic member are exclusively and resiliently transmitted through said regions of elevations, and where said multiplicity of regions of elevations are planar surfaces contained in said upper surface and said regions of depressions are planar surfaces contained in said upper surface and where said planar surfaces of said regions of elevations and depressions are substantially parallel;

(b) elastic mounting means carried by said elastic member for removably mounting said elastic member to said musical instrument.

12. The shoulder rest for a violin recited in claim 11 wherein said elastic mounting means comprises an elastic band having laterally opposing bights for attachment to a lower bout of said musical instrument and an end peg of said musical instrument respectively.

13. The shoulder rest for a violin recited in claim 12 wherein said elastic member has a laterally extending cavity therethrough and said elastic band is captively held within said cavity.

14. The shoulder rest for a violin recited in claim 13 where said regions of elevations are symmetrically located with respect to said longitudinal axis.

15. In combination:

(a) a violin or viola musical instrument;

(b) a shoulder rest having an upper boundary surface, a bottom boundary surface and a peripheral boundary surface made entirely of a non-rigid resilient compressible elastic material and having a longitudinal axis, where said shoulder rest comprises an elastic member having an upper surface coincident with and identical to said upper boundary surface, a bottom surface coincident with and identical to said bottom boundary surface, and a peripheral surface coincident with and identical to said peripheral boundary surface and integrally interconnecting said upper and bottom surfaces of said elastic member, said upper surface having integral therewith a multiplicity of regions of depressions and regions of elevations where said regions of elevations are so dimensioned and proportioned to permit said regions of elevations to exclusively and compressively bear against said musical instrument when said bottom surface is at least in part in compressive engagement with a shoulder such that external forces acting on said upper surface of said shoulder rest are exclusively and resiliently transmitted through said regions of elevations and where said multiplicity of regions of elevations are planar surfaces contained in said upper surface and said regions of depressions are planar surfaces contained in said upper surface and where said planar surfaces of said regions of elevations and depressions are substantially parallel;

(c) elastic mounting means carried by said elastic member for removably mounting said elastic member to said musical instrument.

16. The shoulder rest for the musical instrument recited in claim 15 wherein said elastic mounting means comprises an elastic band having laterally opposing bights for attachment to a lower bout of said musical instrument and an end peg of said musical instrument respectively.

17. The shoulder rest for a violin recited in claim 16 wherein said elastic member has a laterally extending cavity therethrough and said elastic band is captively held within said cavity.

18. The shoulder rest for the musical instrument recited in claim 15 wherein said regions of elevations are symmetrically located with respect to said longitudinal axis.

* * * * *